US007469430B2

(12) United States Patent
Thies

(10) Patent No.: US 7,469,430 B2
(45) Date of Patent: Dec. 30, 2008

(54) PORTABLE SHAMPOO SINK

(76) Inventor: Ailene P. Thies, 248 N. Elm St., Wahoo, NE (US) 68066

( * ) Notice: Subject to any disclaimer, the term of this patent is extended or adjusted under 35 U.S.C. 154(b) by 150 days.

(21) Appl. No.: 10/924,931

(22) Filed: Aug. 25, 2004

(65) Prior Publication Data

US 2005/0086734 A1 Apr. 28, 2005

Related U.S. Application Data

(60) Provisional application No. 60/514,603, filed on Oct. 28, 2003.

(51) Int. Cl.
*A45D 19/04* (2006.01)

(52) U.S. Cl. ..... 4/516; 4/519

(58) Field of Classification Search ..... 4/515–519
See application file for complete search history.

(56) References Cited

U.S. PATENT DOCUMENTS

| | | | | |
|---|---|---|---|---|
| 2,760,207 | A * | 8/1956 | Glintz | 4/516 |
| 3,068,491 | A * | 12/1962 | Perekrestenko | 4/516 |
| 3,731,325 | A | 5/1973 | Guarrasi | |
| 4,081,867 | A * | 4/1978 | Simeola | 4/516 |
| 4,167,048 | A | 9/1979 | Williams | |
| 4,512,043 | A * | 4/1985 | Nolan | 4/516 |
| 4,651,361 | A | 3/1987 | Nolan | |
| 4,660,233 | A | 4/1987 | Beaver | |
| 4,747,169 | A | 5/1988 | Valbuena | |
| 4,901,378 | A | 2/1990 | Reddell | |
| 4,998,302 | A * | 3/1991 | Silva | 4/516 |
| 5,007,118 | A | 4/1991 | Ebersole | |
| 5,014,371 | A | 5/1991 | Heel | |
| 5,144,701 | A | 9/1992 | Clark | |
| D333,343 | S | 2/1993 | Farchione | |
| D342,121 | S | 12/1993 | Lim | |
| 5,301,376 | A | 4/1994 | Herbert | |
| 5,305,481 | A | 4/1994 | Nebb | |
| 5,381,562 | A | 1/1995 | Holloway et al. | |
| D362,715 | S | 9/1995 | Trottier | |
| 5,678,255 | A | 10/1997 | Stoudamire, Sr. | |
| 5,687,434 | A | 11/1997 | Tagg | |

(Continued)

FOREIGN PATENT DOCUMENTS

| | | |
|---|---|---|
| JP | 11-107336 | 4/1999 |

(Continued)

*Primary Examiner*—Charles E Phillips
(74) *Attorney, Agent, or Firm*—Richard C. Litman

(57) ABSTRACT

The portable shampoo sink is a sterilizable apparatus that permits bedridden individuals to have their hair shampooed while lying down. The apparatus may be used in a hospital or at home. A rolling cabinet on wheels has a sink shaped with a semicircular depression for receiving the neck or head of the individual. The cabinet stores both hot and cold water in tanks disposed within the cabinet. A motorized heater heats the water in one tank. Water is pumped up to a spray nozzle via a flexible conduit as controlled by a control on the sprayer and hot and cold water spigots. The wastewater collected in the basin drains through a conduit into a waste/drainage collection tank disposed under the basin. Two side doors permit access to the tanks, heater and pump. The sides of the cabinet have shelves for placement of washing accessories such as shampoo and the like.

14 Claims, 3 Drawing Sheets

U.S. PATENT DOCUMENTS

| | | | |
|---|---|---|---|
| 5,704,078 | A | 1/1998 | Chandler |
| 5,813,063 | A | 9/1998 | Watkins et al. |
| D401,679 | S | 11/1998 | Tagg |
| 5,966,751 | A | 10/1999 | Chiarelli |
| 6,076,202 | A | 6/2000 | Lockwood |
| 6,161,228 | A | 12/2000 | Wietecha |
| 6,173,458 | B1 | 1/2001 | Maddux |
| 6,427,259 | B1 | 8/2002 | Cawthon |
| 2001/0052681 | A1 | 12/2001 | Deavila |
| 2002/0066141 | A1 | 6/2002 | Diaz Rivera et al. |
| 2003/0019031 | A1 | 1/2003 | Mosis |

FOREIGN PATENT DOCUMENTS

| | | |
|---|---|---|
| WO | WO 99/20848 | 4/1999 |

* cited by examiner

PORTABLE SHAMPOO SINK

CROSS-REFERENCE TO RELATED APPLICATION

This application claims the benefit of U.S. Provisional Patent Application Ser. No. 60/514,603, filed Oct. 28, 2003.

BACKGROUND OF THE INVENTION

1. Field of the Invention

The present invention relates generally to sinks. More specifically, the invention is a portable wheeled cabinet containing a sink for that dispenses hot and cold water from stored water supplies.

2. Description of the Related Art

The related art of interest describes various sinks, but none discloses the present invention. There is a need for a wheeled cabinet capable of supplying a sink for comfortably shampooing the hair of children and bedridden persons. The related art will be described in the order of perceived relevance to the present invention.

U.S. Pat. No. 5,678,255, issued on Oct. 21, 1997, to Melvin C. Stroudamire, Sr. describes a portable hair washing system that has a collapsible basin table for transporting. The system comprises: a collapsible basin table having a top member supported by a plurality of telescopic legs; a first collapsible container having a spout; a second collapsible container having a spout; a first flexible conduit having a connector end and a nozzle end; and a second flexible conduit having a first and second connector end. A curved portion extends downwardly forms a neck surface extending into the basin for resting the user's neck. The portable hair washing system may also have a collapsible tray assembly and a case for carrying the equipment. The apparatus is distinguishable for requiring separate carts.

U.S. Pat. No. 5,014,371, issued on May 14, 1991, to Jurgen D. Heel describes a portable salon unit that includes a movable cart having a washbasin. The washbasin is adjustable vertically. A device for supplying clean water to an object located in the basin includes a water connector at one end and a spraying end. A flexible supply hose is provided on a supply reel to allow the water connector to be located at some distance from the cart. The apparatus is distinguishable for requiring a spatially separated washbasin from the cart.

U.S. Patent Application Publication No. US 2003/0019031 A1, published on Jan. 30, 2003, for Joseph K. Mosis describes a portable sink with internal or optionally external water supply comprising a double sink with and one faucet mounted on a lightweight cabinet with wheels. Hot and cold water are produced by the faucet from either an internal self-contained fresh water tank or an optional external source that passes from a sink to a self-contained used water holding tank. The cabinet has two doors for accessing it's interior. The cabinet holds a self-contained fresh water holding tank and one self-contained used water holding tank. A heater heats the water coming from either the internal or optional external water source. The apparatus is distinguishable for requiring a double basin and optionally an external source of hot and cold water.

U.S. Design Pat. No. 333,343, issued on Feb. 16, 1993 to Samuel P. Farchione describes an ornamental portable shampoo and styling unit apparatus comprising a wheeled cabinet having a contoured sink with an indented front space for laying down the head, an array of electrical outlets and hose connections on a block extension on its left side, and a horizontal bar and water hose connections in the rear cavity. The ornamental apparatus is distinguishable for requiring an ornamental contoured sink having an indented front portion.

U.S. Design Pat. No. 342,121, issued on Dec. 7, 1993 to Jong Y. Lim describes an ornamental combined foldable and portable sink table in a folding case with four folding legs, a hinged cover with internal drying shelves and pegs, two hinged side tables, and a sink and draining table. The ornamental apparatus is distinguishable for requiring an ornamental folding sink table.

U.S. Design Pat. No. 362,715, issued on Sep. 26, 1995 to Michael A. Trottier describes an ornamental portable sink for overlying a utility tub comprising a stainless steel sink basin with side handles and various side panel apertures for toothbrushes, hair brush, a soap bottle, and a soap dish depression. The ornamental apparatus is distinguishable for requiring only a portable sink for overlying a utility tub.

U.S. Design Pat. No. 401,679, issued on Nov. 24, 1998 to Richard L. Tagg describes an ornamental portable sink comprising a base cabinet having four oval sinks with a single faucet each on top covered by an umbrella on a pole having two soap dispensers. Two apparent water containers are located on opposite sides of the wheel-less base cabinet. The ornamental apparatus is distinguishable for requiring multiple sinks, an umbrella cover and lacking wheels.

U.S. Patent Application Publication No. US 2001/0052681 A1, published on Dec. 20, 2001 for Pericles Deavila describes a mobile safety compliance apparatus comprising a rectangular box shell having a plurality of open compartments having doors, a self-contained water supply, and a wastewater collection system. Removable doors serve also as a stretcher or a freestanding table. The water supply provides drinking water, tepid hand washing water, and water for a stowaway eyewash hingedly attached to the shell. A stowaway seat and table are hingedly attached to the shell. The apparatus includes an electrical system with a battery backup for powering the lights, water heating, refrigeration devices, electronic communication equipment, and two wheels and two anchor points. The apparatus is distinguishable for requiring a stowaway seat and table, a battery backup, and electronic communication equipment.

U.S. Patent Application Publication No. US 2002/0066141 A1, published on Jun. 6, 2002 for Josue' D. Rivera et al. describes a collapsible and portable work sink station comprising a collapsible telescopic four leg structure. The apparatus is distinguishable for requiring collapsible telescopic legs.

U.S. Pat. No. 3,731,325, issued on May 8, 1973 to Joseph S. Guarrasi describes a potable hair wash sink attachment apparatus comprising a board section and a neck yoke section. The board section can be attached to the front wall of a sink basin to extend upward and outward. The neck yoke section can slide along the board and fits around the neck of the user. A dish attached slidingly to the board is placed under the chin to collect any excess wash water drain down the board into the sink. The apparatus is distinguishable for requiring a board section and a neck section to attach to a sink.

U.S. Pat. No. 4,167,048, issued on Sep. 11, 1979 to Mary E. Williams for a portable shampoo seat adapter with a liquid run-off attachment apparatus for children that is disposed on the seat of a conventional barber or beautician chair with the back thereof adjacent to and below a conventional shampoo wash bowl. A headrest on the backrest of the seat adapter is disposed in front and above the shampoo washbowl on which rests the neck of the child. A water run-off guide extends from the neck rest and surrounds the neck to provide a path over which water dripping from the child's hair is returned to the shampoo wash-bowl. The apparatus is distinguishable for being limited to washing children's hair on a barber or beautician chair, and requiring a water run-off guide on the neck rest.

U.S. Pat. No. 4,512,043, issued on Apr. 23, 1985 to William D. Nolan describes a portable rectangular hair shampoo and scalp treatment basin in a closed box-like form with the removed top connected to the head receiving end of the basin box and acting as a sloped backrest support. The basin's head receiving end has a sloped backrest support for the person, and a half-moon cutout at the top of the end wall for receiving the neck. A hand pump is located in the waterline of a downwardly curved nozzle pipe, and another spray nozzle is located in the end facing upwards. The apparatus is distinguishable for requiring a backrest, a hand pump and two water nozzles, U.S. Pat. No. 4,651,361, issued on Mar. 24, 1987 to William D. Nolan describes a portable combination hair shampoo basin and a drying hood for a bedridden person receiving shampooing, hair coloring, permanent hair waving, and the subsequent drying. The box-like apparatus has a double-walled basin reservoir and a half-moon cutout in a front wall for the neck. The basin's inner wall has a plurality of openings that drain the water poured from a pitcher over the head through a hose. After the shampoo, the water is drained from its reservoir, a blow dryer inserted in an outer wall opening is activated, and hot air forced into the reservoir and out the plurality of openings. The apparatus is distinguishable for requiring a plurality of holes in one side of the box.

U.S. Pat. No. 4,660,233, issued on Apr. 28, 1987 to Lueretta Beaver describes a portable shampoo, manicure, pedicure and washing apparatus comprising a wheeled cabinet housing clean and waste water tanks, and heating and pressurizing means for the clean water. Head and foot basins having drains to the waste water tank are pivotally mounted on lining arms. The support mounting the basins on the cabinet also provides for vertical adjustment to accommodate different bed heights. Spray nozzles connected to the pressurized, heated and clean water tank are extendible by hoses. The apparatus is distinguishable for requiring pivotally mounted head and foot basins.

U.S. Pat. No. 4,747,169, issued on May 31, 1988 for Rene F. Valbuena describes a portable sink having a pressurized water supply comprising a main case having a hinged top cover and containing a two-unit sink bowl unit and a supply tank in an inner case. The apparatus is distinguishable for requiring at least four different containers.

U.S. Pat. No. 4,901,378, issued on Feb. 20, 1990 to Lealyce Reddell describes a shampoo basin comprising a first embodiment having a rectangular basin with a front semicircular neck supporting cutout having a row of water delivering apertures below it on the inside surface of the basin. A spray nozzle on a flexible conduit is positioned on the upper rear edge of the basin. The apparatus is distinguishable for requiring two water delivery sources.

U.S. Pat. No. 5,007,118, issued on Apr. 16, 1991 to Larry W. Ebersole describes a head care station on rollers and kit for reclining a wheelchair occupant against a head support having an adjustable height basin with a frontal semicircular head support notch. The apparatus is distinguishable for requiring a rollable head care station.

U.S. Pat. No. 5,144,701, issued on Sep. 8, 1992 to Ralph W. Clark describes a wheel chair shampoo apparatus for mounting and positioning a wheel chair in a tilted position to a shampoo basin mounted in an open cart and the water supply in a mounted pouch. FIG. 8 describes a washbasin entrance with a semicircular collar, which is slidably movable outward. The shampooing apparatus is distinguishable for requiring an open cart, a mounted water pouch and designed for mounting a wheel chair.

U.S. Pat. No. 5,301,376, issued on Apr. 12, 1994 to Norbert G. Herbert describes a portable sink apparatus comprising three separable housing sections stacked for transport or storage. The middle housing includes a sink that receives water from the upper housing and drains to the bottom housing. The apparatus is distinguishable for being limited to a three-section portable case.

U.S. Pat. No. 5,305,481, issued on Apr. 26, 1994 to J. Clyde Nebb describes a mobile salon station comprising a rear-wheeled open cart having two upright frame members that are vertically telescopic and joined on top. A basin that is carried inverted is placed upright on a shelf, and its water supply connected to two 4.5 gallon tanks carried on a bottom shelf. The basin has a shallow recess for the neck. The apparatus is distinguishable for requiring an open cart with a telescopic upper frame.

U.S. Pat. No. 5,381,562, issued on Jan. 17, 1995 to Joan M. Holloway et al. describes a contoured portable rectangular basin for cleaning a selected part of a person's body such as the head or a limb. The basin has a notched seat for one's neck. An outlet port has a drainage tube. The apparatus is distinguishable for being limited to a basin.

U.S. Pat. No. 5,687,434, issued on Nov. 18, 1997 to Richard L. Tagg describes a portable stand-alone wash station comprising an upright paper towel and soap dispenser unit, a sink unit containing two basins, a flexible inner tank for used water, and a rigid outer tank for fresh water. The apparatus is distinguishable for requiring paper towel and soap dispensers.

U.S. Pat. No. 5,704,078, issued on Jan. 6, 1998 to Velma Chandler describes a portable sink comprising a cabinet containing a 5 gallon bottle of water. The sink is designed to drain into a portable toilet, and a supply of deodorizing soap operates to clean the user's hands and deodorize the apparatus. The apparatus is distinguishable for requiring only a wash-basin and a water bottle.

U.S. Pat. No. 5,813,063, issued on Sep. 29, 1998 to Louis S. Watkins et al. describes a portable sink having four telescopic legs. The housing has a basin, a drainage system, a fresh water supply system, and an electrical system for servicing the basin. The basin is formed as a drawer in the front of the housing. The apparatus is distinguishable for requiring electricity, telescopic legs, and the basin in a drawer.

U.S. Pat. No. 5,966,751, issued on Oct. 19, 1999 to Shirley A. Chiarelli describes a portable hair washing apparatus comprising a basin having a shaped neck support, a horizontal head support, a flexible drainage hose, and a used water receptacle combined and encased in a carrying case. The apparatus is distinguishable for requiring a carrying case configuration.

U.S. Pat. No. 6,076,202, issued on Jun. 20, 2000 to M. Olene Lockwood describes a shampoo sink system comprising a telescoping vertical support assembly having a telescoping horizontal sidewall brace ending in a suction cup. The sink has a rear-hinged liner having a semicircular anti-drip lip sitting in an exterior plastic sink and supported by the telescoping vertical support. The apparatus is distinguishable for requiring a vertical and horizontal telescoping support structure, and a hinged liner for the basin.

U.S. Pat. No. 6,161,228, issued on Dec. 19, 2000 to Jan Wietecha describes a portable sink structure attachable to an external portable reservoir capable of containing wastewater and carried in a case. The sink has no neck depression. The apparatus is distinguishable for having a sink without a neck depression and requiring the sink to fit into a case structure.

U.S. Pat. No. 6,173,458 B1, issued on Jan. 16, 2001 to Larry J. Maddux describes a portable self-contained sink and water storage cart on wheels having a two-cavity sink inside a sink module lacking any neck depression, a towel rack, a soap dispenser, an angled spigot, hot and cold water knobs, and in a lower compartment a fresh water tank, a used water reservoir, a pump, a heater, and electrical connections. The apparatus is distinguishable for lacking a neck depression in its sink.

U.S. Pat. No. 6,427,259 B1, issued on Aug. 6, 2002 to Gregory S. Cawthon describes an outdoor portable lidded sink capable of being connected to a water supply, and having folding legs, an adjustable spigot, a spray nozzle, a storage drawer, a shelf, a large drain, a funnel, a strainer for the drain, cutting boards, baskets, and the like. The sink is U-shaped and lacks any neck depression. The sink is distinguishable for requiring a water connection and a U-shaped sink lacking a neck depression.

Japan Patent No. 11-107336, published on Apr. 20, 1999, for Motoyuki Kawanishi describes a square-shaped portable sink having a water tap elevated above the sink by a strut support and connected to a city water pipe by a hose. A bottom drain has a separate drain hose. The sink can be staked to the ground. The apparatus is distinguishable for utilizing a connection to available water supply and draining on the ground.

W.I.P.O. Application No. WO 99/20848, published on Apr. 29, 1999, for Aseptico, Inc., U.S. describes a portable sink apparatus comprising a rectangular sink without a neck rest having a gooseneck spigot, a drain leading by a hose to a water container, a water supply container providing water to the spigot by a foot pump and heated by an electrical outlet, and four foldable legs. The apparatus is distinguishable for lacking a neck rest in the sink and requiring foldable legs.

None of the above inventions and patents, taken either singly or in combination, is seen to describe the instant invention as claimed. Thus, a portable shampoo sink solving the aforementioned problems is desired.

SUMMARY OF THE INVENTION

The portable shampoo sink apparatus is a cabinet disposed on wheels possessing a sink having a semi-circular depression on a front sink counter edge for receiving a user's neck. The semi-circular depression is contoured and padded to allow the user to comfortably rest their neck or the back of their head. The cabinet has a recessed portion on a front wall that is designed to accommodate an end of a hospital bed or other type of bed. A hinged back and shoulder rest conceals the recessed portion and thus must be lifted up to insert the bed into the recessed portion. Once the bed is inserted in the recessed portion, the back and shoulder rest is laid down on the bed in an inclined plane. The back and shoulder rest props the user's body up so the neck or the back of the head can rest comfortably within the semi-circular depression.

Doors are disposed on the sides of the cabinet for access to a waste/drainage collector tank and a hot and cold water supply tank. The hot water is created by a motor driven heater and dispensed by a pump that is held within the cabinet. The tanks are placed on a shelf and can be slid in and out of the cabinet. The sliding action of the water tanks allows the water tanks to be moved in and out of the cabinet to view the entire tank as it is being filled and therefore prevent overfilling. Also, by being able to slide the tanks in and out of the cabinet they can easily be cleaned outside the cabinet when necessary. On both sides of the cabinet are removably attachable external storage shelves for storing medicines, lotions and the like.

The portable shampoo sink apparatus is intended for children and infirm adults hospitalized in bed. However, seated individuals such as those who use wheelchairs can also use the portable shampoo sink apparatus. The wheelchair can be backed into the portable shampoo sink being of a sufficient height to accommodate the wheels of the wheelchair. The apparatus also accommodates for the handles of the wheelchair by allowing the handles to rest in the recessed portion on the cabinet by having first removed the back and shoulder rest.

Accordingly, it is a principal object of the invention to provide a portable shampooing sink and cabinet.

It is another object of the invention to provide a portable shampooing sink and cabinet for use by bedridden persons and children to lay their heads over a padded neck rest.

It is a further object of the invention to provide a portable shampooing sink and cabinet having its own hot and cold water supply.

Still another object of the invention is to provide a portable shampooing sink and cabinet on wheels with removable storage shelves on its sides containing lotions, medicines and the like.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
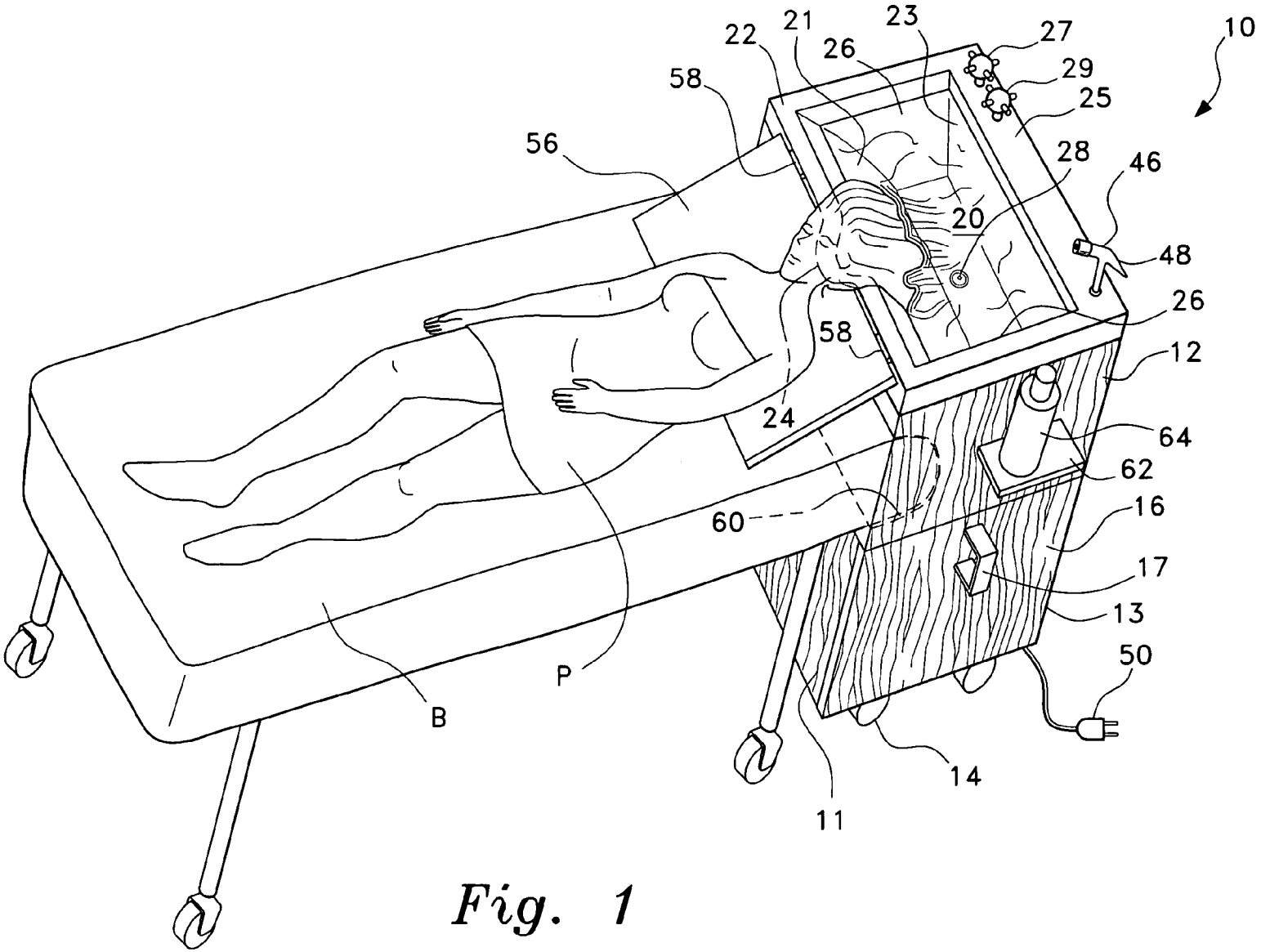
FIG. 1 is an environmental perspective view of a portable shampoo sink apparatus according to the present invention wherein a patient lying on a bed is positioned on the sink of the apparatus.
Figure 2:
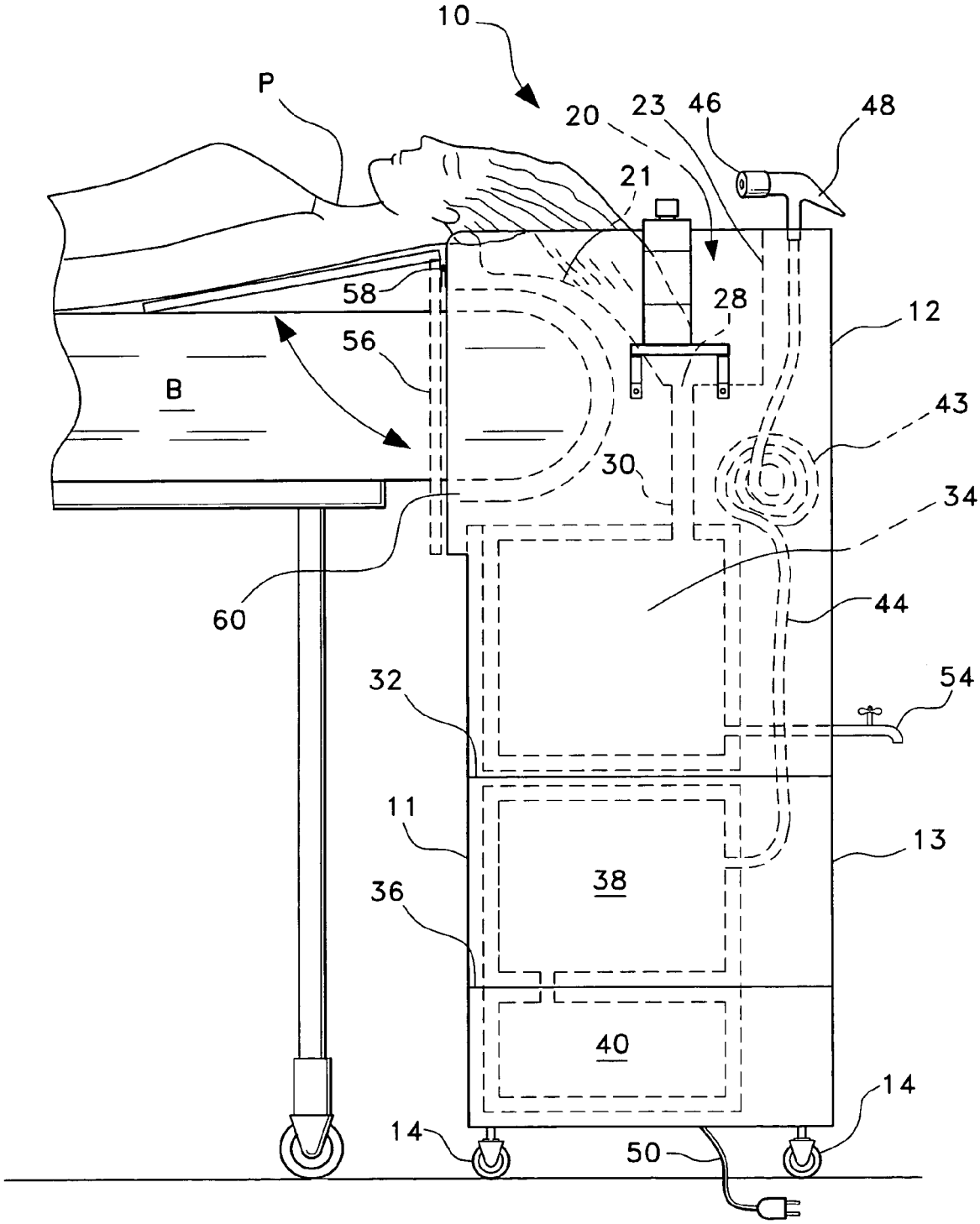
FIG. 2 is a side view of a portable shampoo sink apparatus according to the present invention showing the interior parts in shadow and excluding the external storage shelf.
Figure 3:
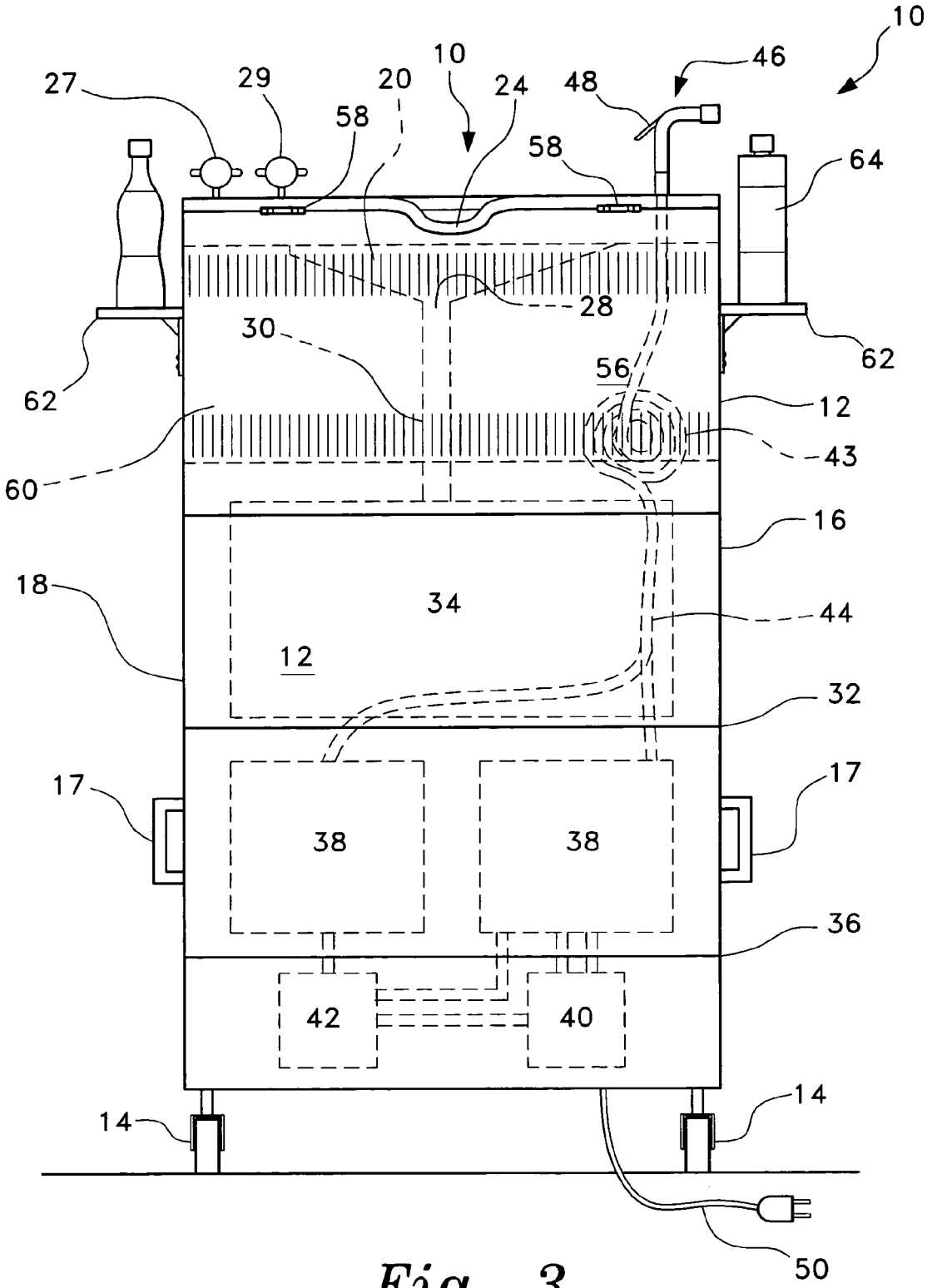
FIG. 3 is a front elevational view of a portable shampoo sink apparatus according to the present invention.

The present invention illustrated in FIGS. 1 to 3 is directed to a portable shampoo sink apparatus 10 comprising a metal or sterilizable plastic cabinet 12 on wheels or casters 14. The cabinet 12 has a front wall 11, a back wall 13, two sidewalls having two side doors 16, 18 with door handles 17 and a bottom wall to which the wheels 14 are connected. The cabinet 12 can have shelves 62 on each sidewall for holding shampooing accessories 64 such as medicines, lotions and the like. The shelves 62 are removably attachable or can be hinged to fold up when not being used.

A back and shoulder rest 56 is removably attached to the cabinet 12 by hinges 58. The rest 56 is padded to comfort the back and shoulder. The rest 56 is disposed over a U-shaped recess 60 that extends the width of the cabinet 12. Hinges 58 can be taken apart to allow the rest 56 to be removed when it is not needed. The U-shaped recess 60, and therefore the cabinet 12, is wide enough to accommodate or receive the length and width of a standard hospital bed B end or any other bed. The ends of the recess 60 may be closed off by the sidewalls of the cabinet 12, as shown in the figures, or the sidewalls may be cut out or not occupy the ends of the recess 60 so wider bed ends can be accommodated within the recess 60.

The cabinet 12 has a top portion to which a sink or basin 20 is disposed. The basin 20 has a padded semicircular depression 24 on a padded front counter edge 22 of the basin 20. The semicircular depression 24 is designed for resting a patient's P neck or back of the head so that only hair will fall into the basin 20. A rear counter edge portion 25 of the basin 20 has a hot water spigot 27 and a cold water spigot 29.

Looking at FIG. 1 in conjunction with FIG. 2, the basin 20 has a front convex wall 21, an upright planar rear wall 23 and two inclined sidewalls 26 connecting the front convex wall 21 and upright planar rear wall 23. The front convex wall 21 is curved to accommodate the U-shaped recess 60 that extends the width of the cabinet 12. The basin 20 empties to a drain aperture 28 that removes effluent gray water by a conduit 30 to a waste/drainage collector tank 34 of the cabinet 12 disposed on a shelf 32. The waste/drainage collector tank 34 has a capacity of six gallons. The waste water collected in the waste/drainage collector tank 34 is discarded either by removing the tank 34 from the shelf 32 or by draining the waste water through an drainage spigot 54 that is connected to the tank 34 and is ideally disposed on the back wall 13 of the cabinet 12.

As shown in FIGS. 2 and 3, below the waste/drainage collector tank 34 are two three gallons tanks 38 one is designed to hold unheated water the other holds heated water that has been heated by a motor driven heater 40. The tanks 38 are disposed on a shelf 36. The shelves 34, 36 are ideally disposed within the cabinet 12 on sliding mechanisms such as drawer slides to easily pull the tanks 34, 38 out of the cabinet. The sliding action of the shelves 34, 36 allow the water tanks 38 to be moved out of the cabinet 12 to view the entire tank 38 as it is being filled and therefore prevent overfilling.

A pump 42 forces fresh water from the tanks 38 through a flexible conduit 44 to a hand sprayer 46 when triggered by a trigger control 48 on the sprayer 46 and spigots 27, 29. A portion of the flexible conduit 44 is coiled 43 so the sprayer 46 can be easily pulled out and manipulated by the user. As an alternative to the sprayer 46, a standard faucet can be used to dispense the water from the tanks 38. The motorized heater 40 works in conjunction with one of the tanks 38 and the hot water spigot 27 to heat water prior to it being dispensed out of the hand sprayer 46. The plumbing connections between the spigots 27, 29 and the tanks 38 have been omitted from the figures for the sake of clarity and since such connections would be easily understood by one of skill in the art. Both the pump 42 and the heater 40 should be insulated.

Caregivers can easily use the apparatus 10 to wash the patient's P hair using the sprayer 46 and the shampooing accessories 64 disposed on the shelves 62 located near the basin 20. The portable shampoo sink apparatus 10 is energized by electricity via an electric cord 50. The pump 42 may run on either electricity or on pressure provided by a pressure pump. The pressure pump will work when electricity is unavailable or when it is not feasible to use electricity for safety reasons. The apparatus 10 therefore may utilize only an electric pump or both the pressure and electric pumps.

The portable shampoo sink apparatus 10 may be used at home or in a hospital and when seated or lying down. If the apparatus 10 were used with the bed B back and shoulder rest 56 would first have to be pivoted up about the hinges 58 so the recess 60 could be accessed and then the apparatus 10 could be rolled to the bed B to allow one end of the bed B to rest within the recess 60, see FIGS. 1 and 2. The back and shoulder rest 56 would then be pivoted down to lie on the bed B in an incline slope and support the patient's P body. The patient's P head or neck would then be nestled in the semi circular depression 24 on the front counter edge 22 of the basin 20. The padded rest 56 comforts the back and shoulder and the padded semicircular depression 24 on the basin 20 allows the patient P to comfortably rest their neck or head.

The apparatus 10 may also be suitable for use by a person sitting in a wheelchair. In this case, the back and shoulder rest 56 must be removed so the handles on the wheelchair can rest within the recess 60. This then comfortably allows the wheels of the wheelchair to be wheeled up against the apparatus 10 so the seated person can rest their neck on the semi circular depression 24. The cabinet 12 can be made to have any height and size however the cabinet 12 will ideally have a height that can accommodate a standard hospital bed B and a wheelchair.

Thus, a rolling cabinet having a specially contoured sink to permit a bedridden person to be shampooed by resting one's neck on a padded neck rest while still lying on the bed has been shown.

It is to be understood that the present invention is not limited to the embodiment described above, but encompasses any and all embodiments within the scope of the following claims.

I claim:

1. A portable shampoo sink apparatus, comprising:

a cabinet having a front wall and a top portion;

a concave recessed portion disposed on the front wall of the cabinet said recessed portion being of a size to receive the length and width of a bed;

a removably attachable back and shoulder rest disposed over the recessed portion on the front wall of the cabinet; and a sink disposed on the top portion of the cabinet having a front sink counter edge with a depression for accommodating a neck of a person when the person is facing up and a front convex wall extending from said edge and occupying substantially the entire front surface of the sink and overlying the concave recessed portion of the cabinet.

2. The portable shampoo sink according to claim 1, wherein said sink has an upright planar rear wall extending to a drain, the front convex wall having a convex bottom portion extending to the drain and two inclined side walls extending to the drain connecting the upright planar rear wall to the front convex wall.

3. The portable shampoo sink according to claim 1, wherein said cabinet further comprises a back wall, two side walls connecting the front wall to the back wall, a door disposed on each side wall, a bottom wall connecting the front wall, the back wall and the two side walls, the bottom wall possessing wheels.

4. The portable shampoo sink according to claim 1, wherein the cabinet is made of sterilizable metal.

5. The portable shampoo sink according to claim 1, wherein the cabinet is made of sterilizable plastic.

6. The portable shampoo sink according to claim 1, further comprising shelves for holding shampooing articles.

7. The portable shampoo sink according to claim 1, wherein the back and shoulder rest is removably attached to the front wall of the cabinet by a hinge.

8. The portable shampoo sink according to claim 1, wherein the cabinet holds water storage tanks and a waste storage tank.

9. The portable shampoo sink according to claim 8, wherein the waste storage tank has a drainage spigot for discarding waste water from the waste storage tank.

10. The portable shampoo sink according to claim 1, further comprising a pump for pumping water from the storage tanks into the sink.

11. The portable shampoo sink according to claim 10, wherein the pump is an electric pump.

12. The portable shampoo sink according to claim 10, wherein the pump is a pressure pump.

13. The portable shampoo sink according to claim 1, further comprising a heater disposed within the cabinet for heating water disposed in one of the storage tanks.

14. The portable shampoo sink according to claim 1, wherein the storage tanks can be slid out of the cabinet.

* * * * *